US010306711B2

(12) United States Patent
Monahan et al.

(10) Patent No.: US 10,306,711 B2
(45) Date of Patent: May 28, 2019

(54) MICROWAVE OVEN WITH DUAL DOORS

(71) Applicant: Bemon, LLC, Denver, CO (US)

(72) Inventors: Brian Monahan, Arvada, CO (US); Chris Becze, Denver, CO (US); Daniel Gallo, Los Angeles, CA (US); Joshua Peifer, Denver, CO (US)

(73) Assignee: Bemon, LLC, Denver, CO (US)

( * ) Notice: Subject to any disclaimer, the term of this patent is extended or adjusted under 35 U.S.C. 154(b) by 864 days.

(21) Appl. No.: 14/280,237

(22) Filed: May 16, 2014

(65) Prior Publication Data

US 2015/0014305 A1 Jan. 15, 2015

Related U.S. Application Data

(60) Provisional application No. 61/824,889, filed on May 17, 2013.

(51) Int. Cl.
*H05B 6/64* (2006.01)

(52) U.S. Cl.
CPC ..... *H05B 6/6414* (2013.01); *H05B 6/6417* (2013.01); *H05B 6/6423* (2013.01); *H05B 6/6426* (2013.01); *H05B 6/6435* (2013.01); *Y10T 29/49002* (2015.01)

(58) Field of Classification Search
CPC ..... F24C 7/06; F24C 7/087; F24C 15/325; F24C 15/16; A21B 1/22
USPC ..... 219/394, 700, 699, 739; 99/468, 472; 345/170
See application file for complete search history.

(56) References Cited

U.S. PATENT DOCUMENTS

| | | | | |
|---|---|---|---|---|
| 6,713,741 B2 * | 3/2004 | Miller | A21B 1/48 219/699 |
| D673,001 S | 12/2012 | Becze et al. | |
| 2009/0179864 A1 * | 7/2009 | Rudolph | F24C 7/085 345/170 |

FOREIGN PATENT DOCUMENTS

| | | | | |
|---|---|---|---|---|
| KR | 10-0778704 B1 | | 5/2006 | |
| KR | 2005111463 | * | 5/2007 | F24C 7/06 |
| KR | 2006042441 | * | 10/2007 | F24C 7/06 |
| KR | 2006048706 | * | 11/2007 | F24C 7/06 |

OTHER PUBLICATIONS

Machine Translation of KR200604244, Mar. 2017.*
Machine Translation of KR2006048706, Mar. 2017.*
Machine Translation of KR2005111463, Mar. 2017.*

* cited by examiner

*Primary Examiner* — Tu B Hoang
*Assistant Examiner* — Thomas J Ward
(74) *Attorney, Agent, or Firm* — Adsero IP

(57) ABSTRACT

Novel microwave ovens and methods of using and manufacturing the same. Some microwave ovens include multiple doors and/or control keypads.

19 Claims, 11 Drawing Sheets

Arrows indicate movement of toggles when door is closed

MICROWAVE OVEN WITH DUAL DOORS

This application claims the benefit, under 35 U.S.C. § 119, of provisional U.S. Patent Application No. 61/824,889, filed May 17, 2013 by Becze et al. and titled, "Microwave Oven with Dual Doors," the entire disclosure of which is incorporated herein by reference.

BACKGROUND

A microwave oven is an appliance for cooking food through a process of bombarding food placed in a cooking chamber with electromagnetic radiation. The radiation is in the microwave spectrum and causes polarized molecules in the food to rotate, building thermal energy, in a process called dialectic heating.

Typically microwave ovens, also simply called microwaves, have a single face for human interaction. This face of the microwave has one door, one keypad for entering the desired cooking parameters, and a cooking chamber accessed via the single door.

Microwaves can also be categorized for home or commercial use. Home microwaves are typically smaller, lighter, and less powerful in terms of the power of the electromagnetic radiation entering the cooking chamber. Commercial microwaves are more powerful in this regard, and as a result are larger and heavier appliances.

BRIEF SUMMARY

A set of embodiments provides microwave ovens, including without limitation a microwave oven with doors and/or keypads on two sides, such as both the front and rear of the assembly. In one aspect of some embodiments, a mechanism can prevent both doors from being open simultaneously and/or prevent both keypads from being operated simultaneously.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION OF CERTAIN EMBODIMENTS

Figure 1:
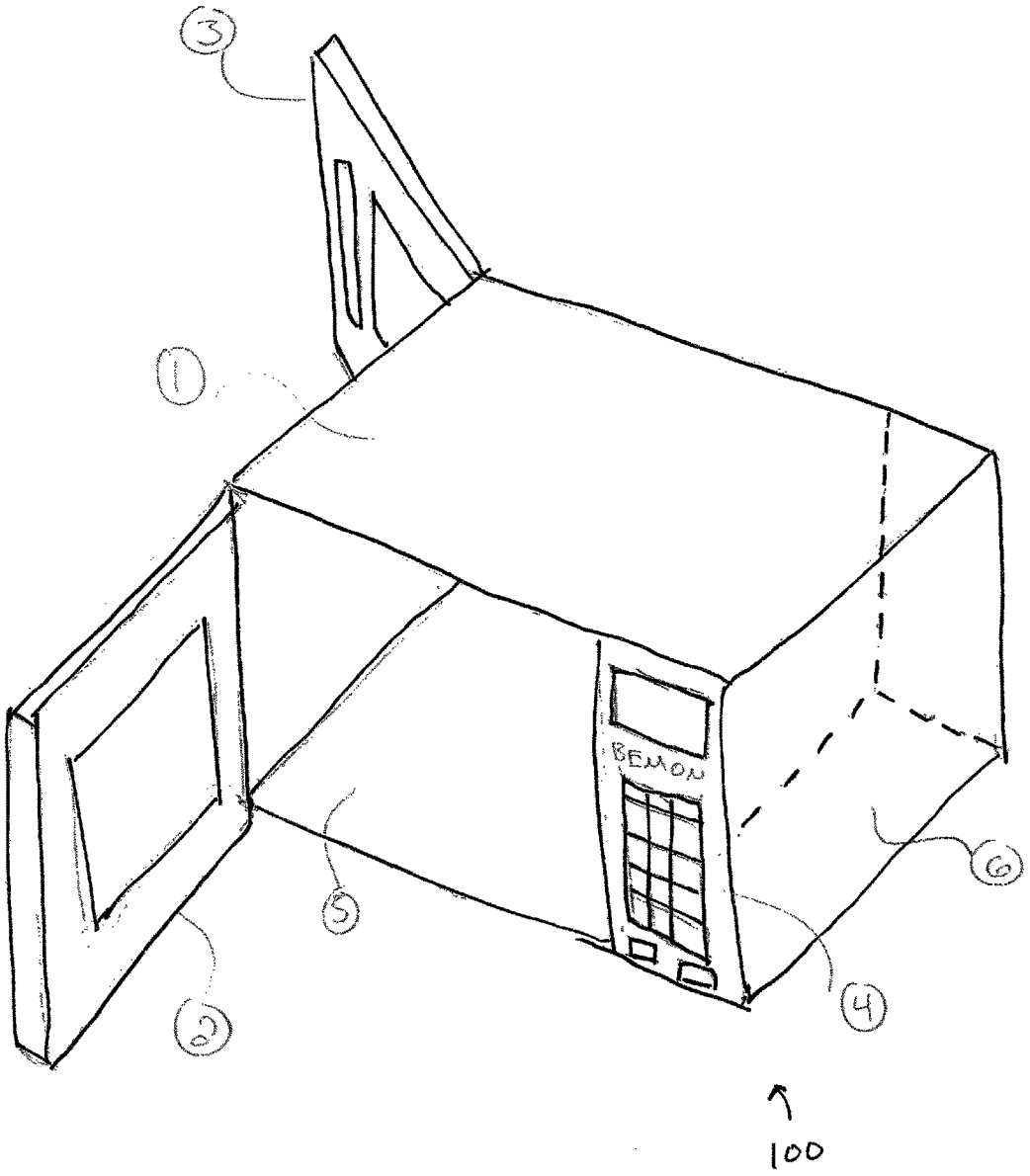
FIG. 1 is a perspective drawing showing a microwave oven with two doors, in accordance with various embodiments.

While various aspects and features of certain embodiments have been summarized above, the following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present may be practiced without some of these specific details. In other instances, certain structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

One set of embodiments provides microwaves, including in particular microwaves with multiple doors and/or keypads. Microwave ovens with two (or more) doors and/or keypads can prove advantageous in a variety of situations. Merely by way of example, a commercial kitchen often will feature a microwave on a central island, and with a conventional, single-door microwave a chef or other user will have to circle the island to the side with the microwave door in order to insert or remove food items from the microwave and/or control operation of the microwave (e.g. to add additional time when cooking a food item). On the other hand, a microwave oven with multiple doors will allow the user to access the interior of the microwave (e.g. to add or remove food) from either side of the island, significantly enhancing the efficiency of the food preparation process. Similarly, a microwave oven with multiple control keypads can allow control of the operation of the microwave from either side of the island. The skilled reader will appreciate that such microwave ovens can have applicability in a variety of other situations as well.

FIG. 1 shows a perspective view of a microwave oven 100 having an oven body 1 with doors 2 and 3 on both the front and rear, respectively, of the appliance, in accordance with one set of embodiments. In this perspective, both doors 2 and 3 are shown open so that they can be seen. As shown, the microwave oven comprises an oven body 1 with a machine room 6 and a cooking chamber 5, which are separated by an internal wall in the oven body. The front face of the assembly also includes an input keypad 4, which allows the user to operate the microwave oven, and in some embodiments, the rear face might include a similar keypad (not shown on FIG. 1). The cooking chamber may or may not include a rotating turntable 7, which allows the food to rotate and cook evenly.

Figure 2:
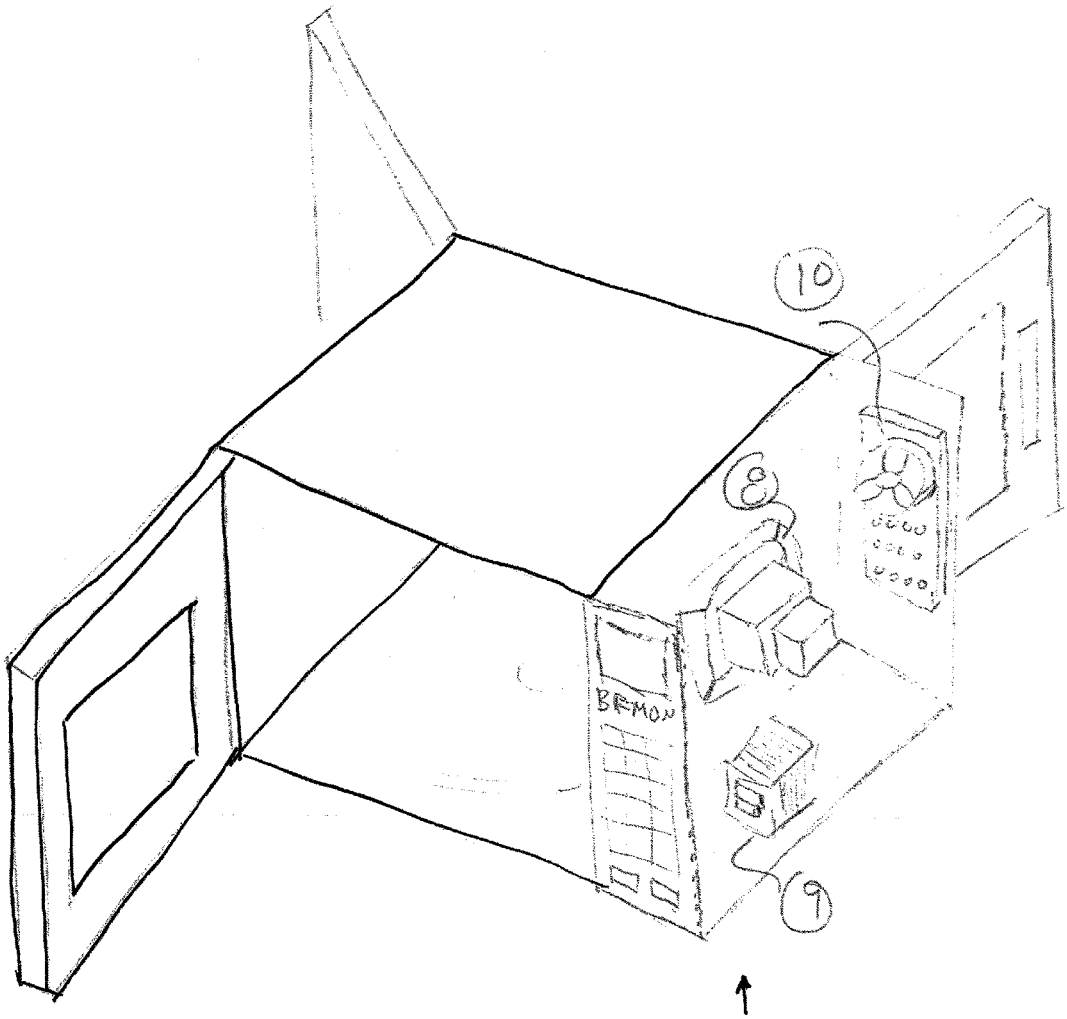
FIG. 2 is a cutaway drawing showing various interior features of a microwave oven having two doors, in accordance with various embodiments.

FIG. 2 shows a perspective view of the microwave oven 100 with a cutaway exposing the contents of the machine room 6. The machine room includes a magnetron 8, which supplies electromagnetic radiation into the cooking chamber 5; a high voltage transformer 9, which supplies power to the magnetron; and a blower fan 10, which removes excess heat and odor from both the cooking chamber and machine room. It should be noted that, in accordance with some embodiments, electronics (e.g., magnetron, power supply, control electronics, etc.), shielding, and other components similar to those of conventional microwave ovens be used, with appropriate modifications to support dual doors and/or dual input keypads.

Figure 3:
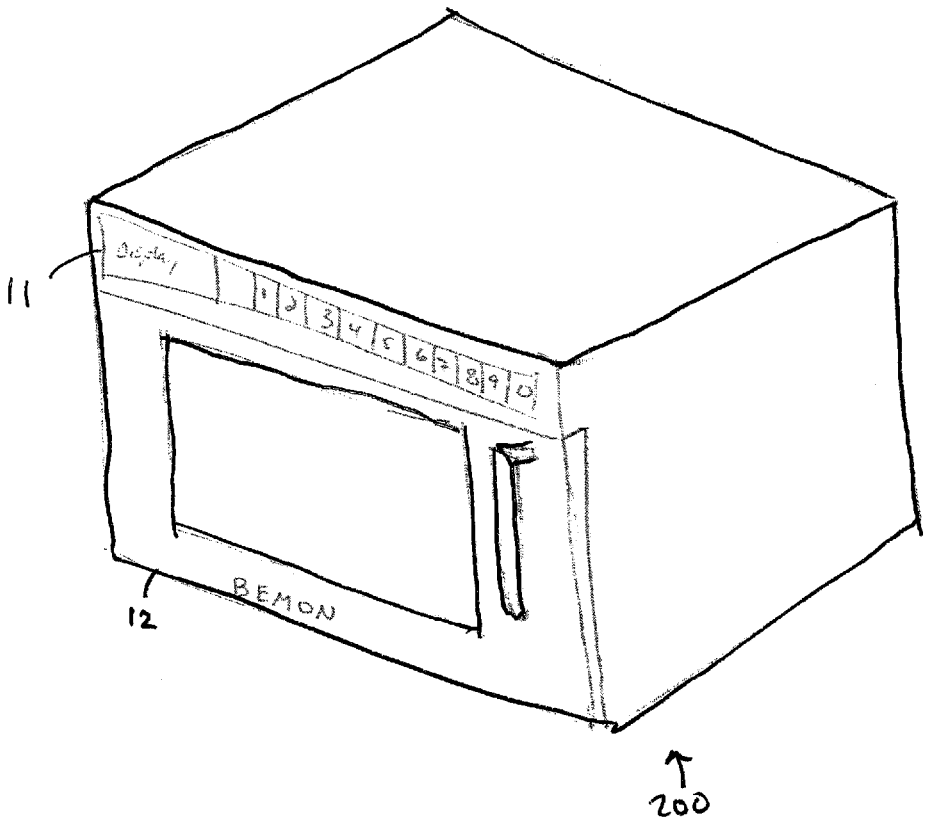
FIG. 3 is a perspective drawing showing a microwave oven with two doors, in accordance with various embodiments.

FIG. 3 illustrates an example of a microwave oven 200 in accordance with other embodiments. In the illustrated example, the microwave oven features a horizontal keypad 11 on a front face of the microwave, above a door 12 also on the front face. In some embodiments, the microwave oven 200 might feature a similar keypad and/or door on a rear face of the microwave oven 200, although those features cannot be seen on the perspective drawing of FIG. 3. Various enhancements and alternatives are possible. For example, in some cases, one or both of the front and back faces might feature two keypads, one above the door and one below the door. In some embodiments, the keypads might employ programmable (e.g., "soft") buttons with dynamic LCD displays or E-Ink displays, to enable the buttons to be programmed by the operator (or manufacturer) for specific functions, and/or to enable the functionality of the keypad(s) to change depending on circumstances (to allow, for example, one of the keypads to change appearance to indicate that it has been disabled when a keypad on the other face is in use).

Figure 4:
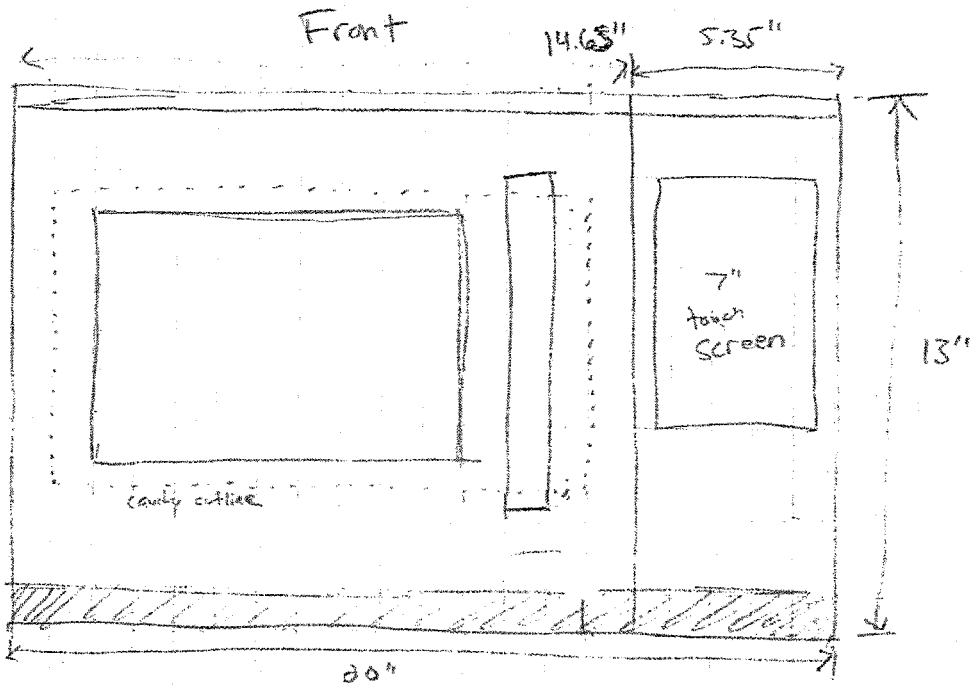
FIG. 4 illustrates dimensions of one exemplary microwave oven, in accordance with various embodiments.
Figure 4:
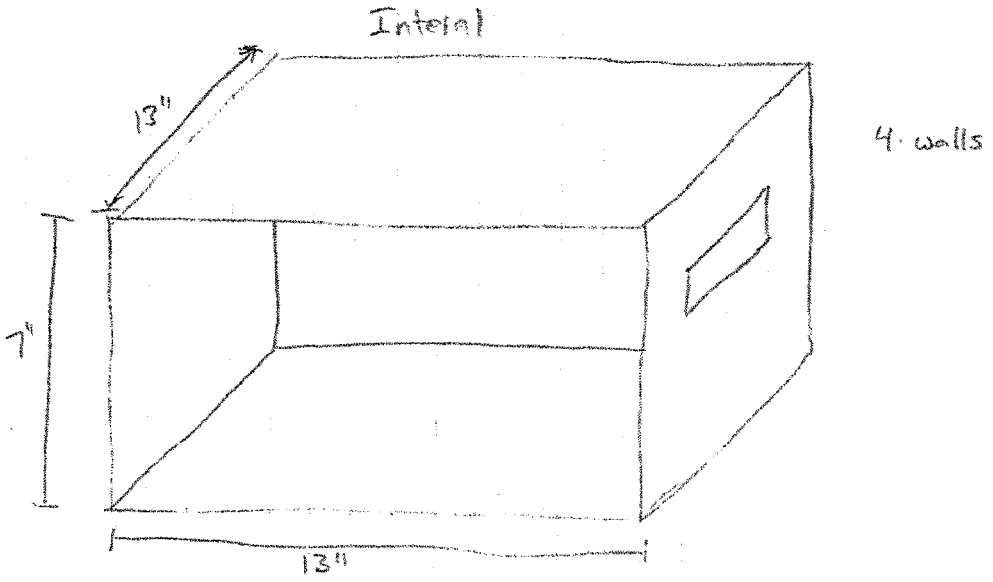

FIG. 4 illustrates exemplary dimensions of a microwave oven in accordance with one set of embodiments, although these exemplary dimensions should not be considered limiting. Microwave ovens in accordance with various embodiments can be produced with any appropriate dimensions. The dimensions of the exemplary microwave shown in FIG. 4 might correspond to an oven with external dimensions of 20" wide×13" high×18" deep (front to back), with an internal cooking chamber of 13" wide×7" high×13×deep (front to back).

Figure 5:
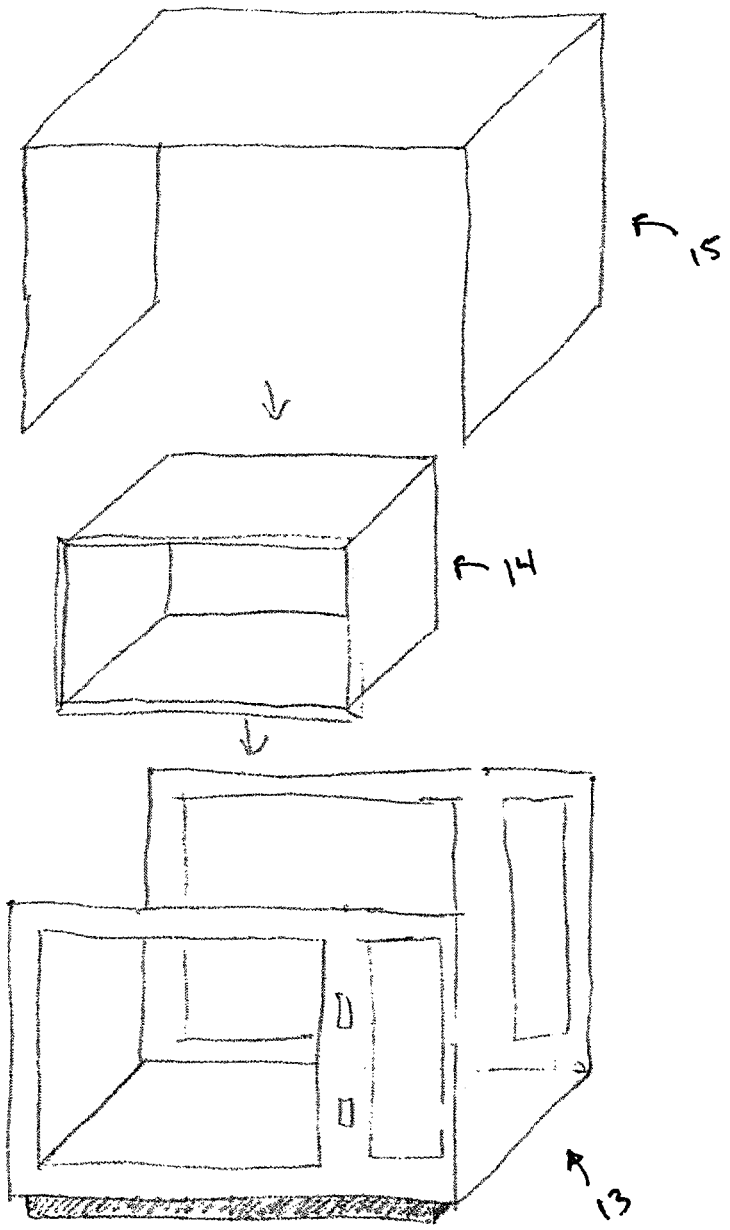
FIG. 5 is an exploded drawing of a microwave oven, in accordance with various embodiments.

FIG. 5 illustrates a basic assembly of an exemplary microwave oven, in which a sheet metal frame 13 might have inserted therein a cooking chamber 14, with a housing cover 15 mounted over the top of the frame 13 and cooking chamber 14. The chamber 14 might have flanges to bolt to the frame 13, and the cover 15 and frame might have corresponding holes into which fasteners can be inserted to secure the components together. The frame 13 might also describe openings in the front and back to be covered with doors, and/or openings in front and back for keypads, as illustrated.

Figure 6:
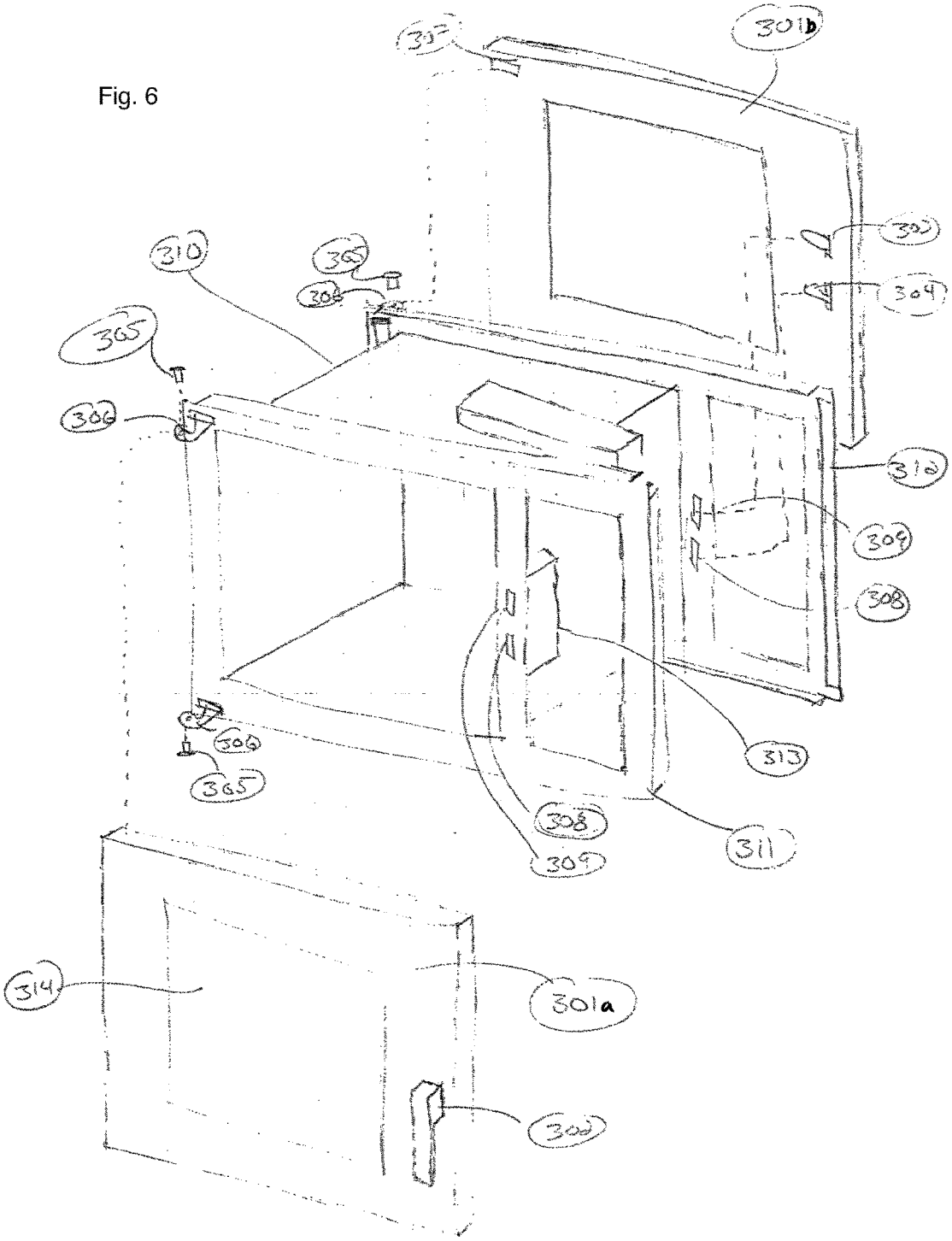
FIG. 6 is an exploded drawing of a microwave oven having two doors, in accordance with various embodiments.

FIG. 6 illustrates an exploded view of a microwave over, illustrating assembly of such an oven in more detail, in accordance with some embodiments. The oven might feature a first door 301 on a front face and a second door 301 on a second (opposing) face, such as the front and rear of the oven. Each door might feature a handle 302 and upper and lower handle latches 303 and 304, respectively, that protrude through upper and lower apertures 309, 308 in the face (e.g., 311) of the frame respectively, when the door 301 is closed. These protrusions 303, 304 can be part of an assembly for latching and/or locking one or both of the doors, as described further below with regard to FIG. 7. (While the exterior of the front door 301*a* and the interior of the rear door 301*b* are shown on FIG. 6, the skilled reader should appreciate that both doors 301 and their operation can be identical, in some embodiments, such that the interior of the front door 301*a* might be similar to that shown for the rear door 301*b*, and the exterior of the rear door 301*b* might be similar to that shown for the front door 301*a*. Similarly, other components can be duplicated between the front and back of the oven.)

The oven can features upper and lower hinges 306 on a front face 311 and a rear face 312, which interface with hinge slots 307 on the doors and can be secured with hinge pins 305 (or similar hardware, such as mounting screws), as shown on FIG. 6. Thus, a cooking chamber 310 of the oven might be covered at front and rear by the doors 301, secured to the front and rear faces 311, 312 respectively, of the frame by hinge assemblies (305-307) and a locking mechanism 313, which can interface with the latches 303, 304 as described below. Each door 301 can feature a viewing window 314 if desired.

Figure 7:
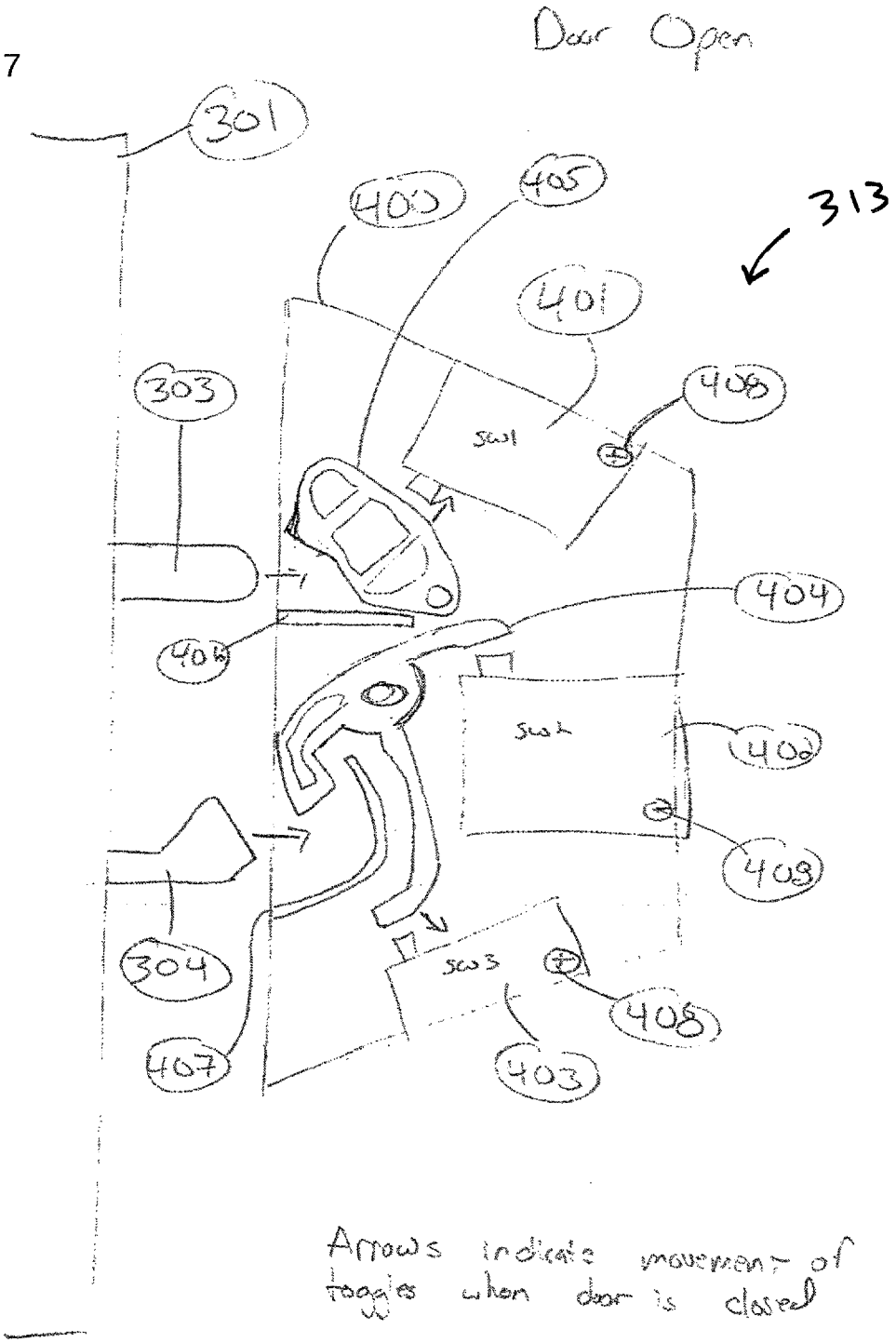
FIG. 7 is a sectional drawing illustrating a door latch for a microwave over, in accordance with various embodiments.

In some cases, it may be advantages for the doors of a multi-door oven to selectively lock, for example, to prevent one door from opening while another door is open or while the oven is in operation. FIG. 7 provides a sectional view of a locking mechanism 313 that can provide such selective locking functionality. As noted, the locking mechanism 313 can interface with protrusions 303, 304 on a door 301, and there can be a locking mechanism 313 for each door on the microwave oven, all of which interface with a microcontroller as described further below. Specifically, each locking mechanism 313 includes a body 400 housing the remaining components. The locking mechanism can further comprise a monitoring switch 401, interlock switches 402, 403 toggles 404, 404, and stabilizing plates 406, 407. Each of the switches 401-403 can be secured by a mounting screw 408 if needed and/or can have a contact for electrical communication with microcontroller and other electrical components of the oven.

In operation, when the door 301 is closed, the upper latch 303, guided by guide 406, engages with an upper toggle (or switch lever) 405 to trigger monitor switch 401, which sends a signal to the microcontroller indicating that the door 301 is closed (and, conversely, when the door 301 is open, the latch 303 is disengaged from the toggle 405 and the toggle releases the switch 401, which sends a signal indicating that the door has been opened. Similarly, the lower latch 304, guided by guide 407, interacts with the lower toggle (or switch lever) 404 when the door is closed. The toggle 404 can trigger interlock switch 403 and/or release interlock switch 402 when the door is closed. Further, one or more of the interlock switches (e.g., switch 402) might comprise a solenoid or other mechanism that, which signaled by the microcontroller can interlock with the toggle 404 to force the toggle 404 to remain closed, which prevents the release of the lower latch 304 and thereby locks the door 301 closed.

Figure 8:
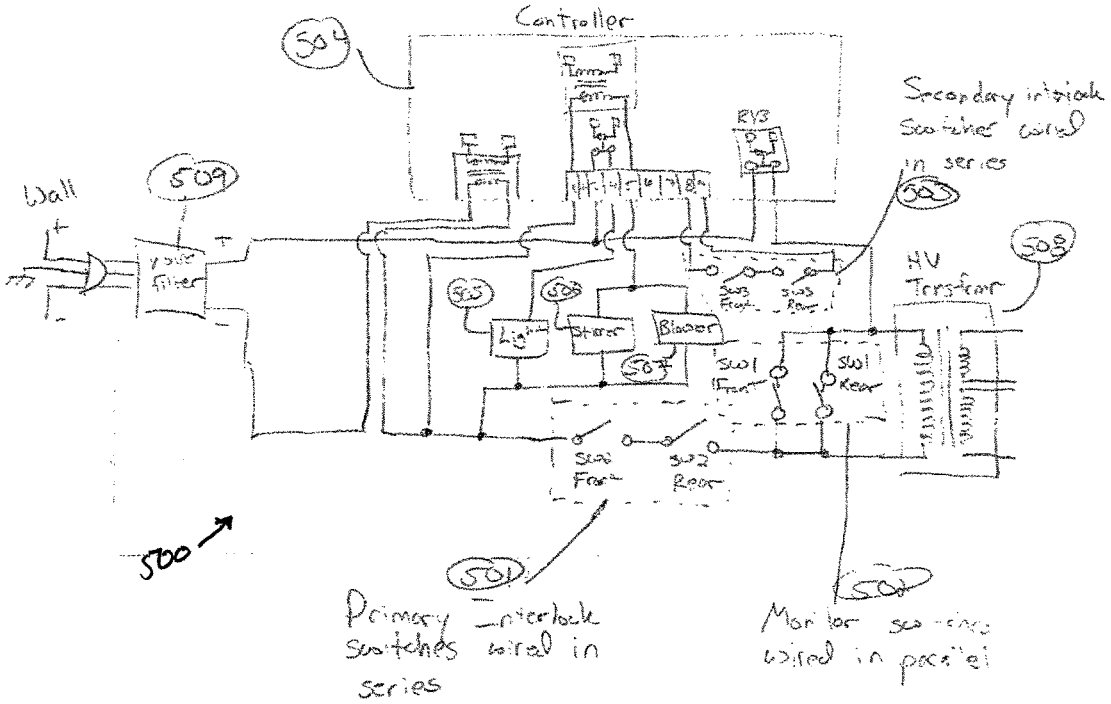
FIG. 8 is a circuit diagram illustrating an electrical circuit for a microwave oven having multiple doors and/or multiple keypads, in accordance with various embodiments.

FIG. 8 illustrates an electrical circuit 500 that can be used to power and/or control a microwave oven, including without limitation a microwave oven that has multiple doors and/or multiple keypads. The circuit includes primary interlock switches 501 (one per door, wired serially in some embodiments) and secondary interlock switches 503 (one per door, wired serially in some embodiments); these switches 501, 503 could be, respectively, the interlock switches 402, 403 described above The circuit can further include monitor switches 502 (one per door, wired in parallel in some embodiments) which could be the monitor switch 401 described above. Arranged as shown, the circuit 500 can also include a controller board 504, along with a cooking chamber light 505, turntable and/or stirrer fan 506, blower fan 507, high voltage transformer 508 (which can provide current to a magnetron, not shown), and a noise filter 509 to provide clean current from a wall outlet.

Figure 9:
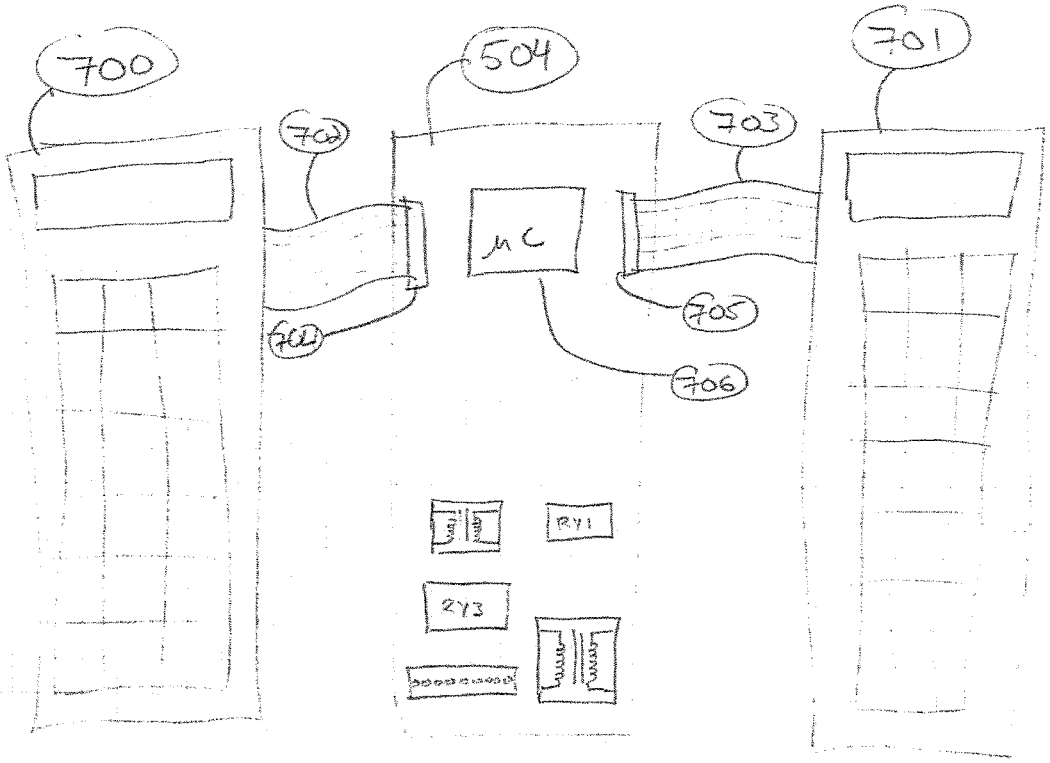
FIG. 9 illustrates two keypads for a microwave oven, in communication with a common controller board, in accordance with various embodiments.
Figure 10:
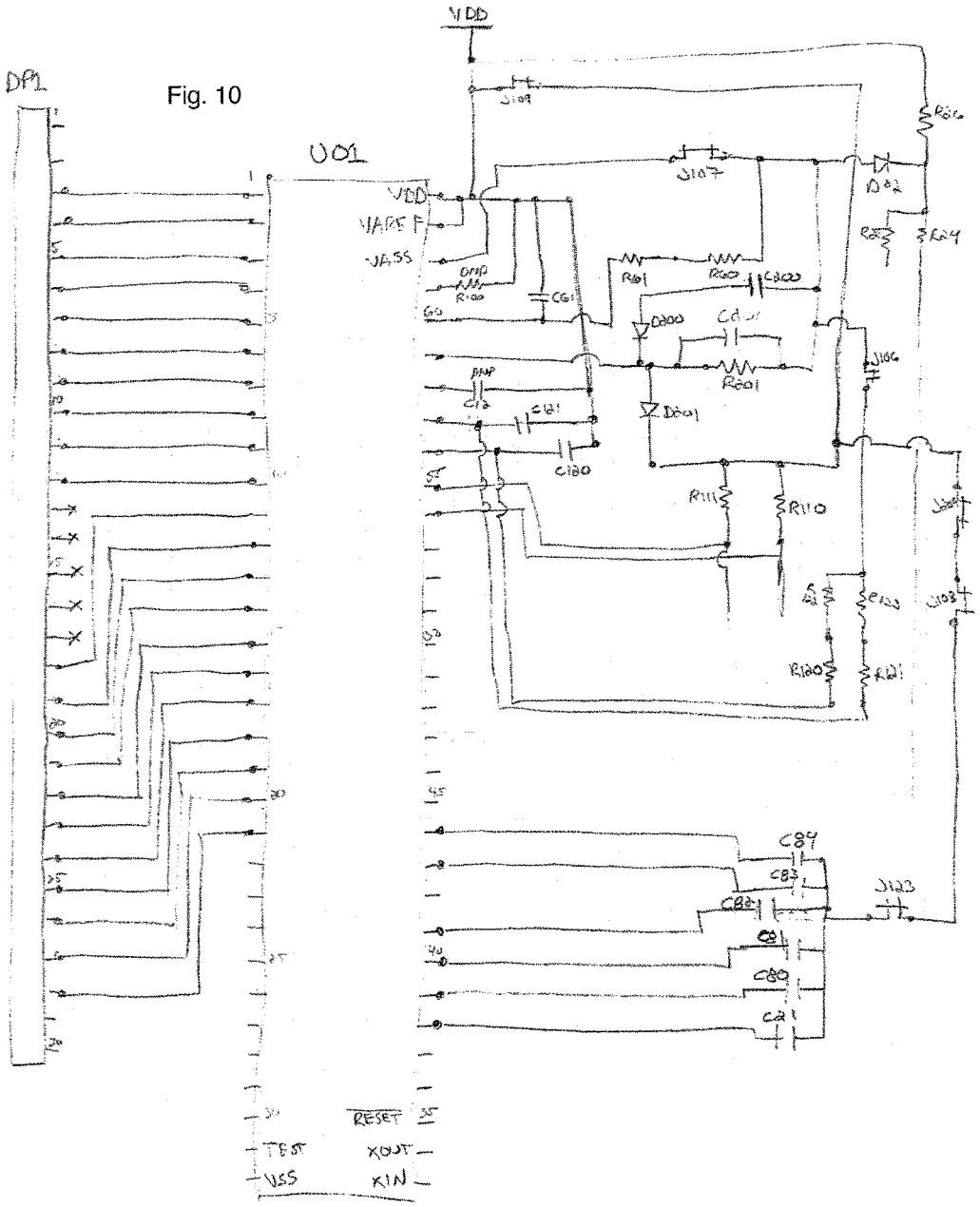
FIG. 10 is a circuit diagram showing a pin-out for a keypad connector on a controller board, in accordance with various embodiments.

FIG. 9 illustrates the controller board 504 of FIG. 8 in further detail. FIG. 9 includes a first (e.g., front) keypad 700 and a second (e.g., rear) keypad 701, in communication with the controller board 504 via ribbon cables 702, 703, respectively, which interface with connectors 704, 705, respectively. (FIG. 10 provides an exemplary circuit diagram that illustrates a pin-out for a connector 704, 705) to provide communication between the keypads 700, 701 and the controller 504, including in particular the microcontroller 706, which can be programmed to control operation of the microwave oven, including operation to accommodate dual doors and/or dual keypads (e.g., as described below with respect to FIGS. 11 and 12).

Figure 11:
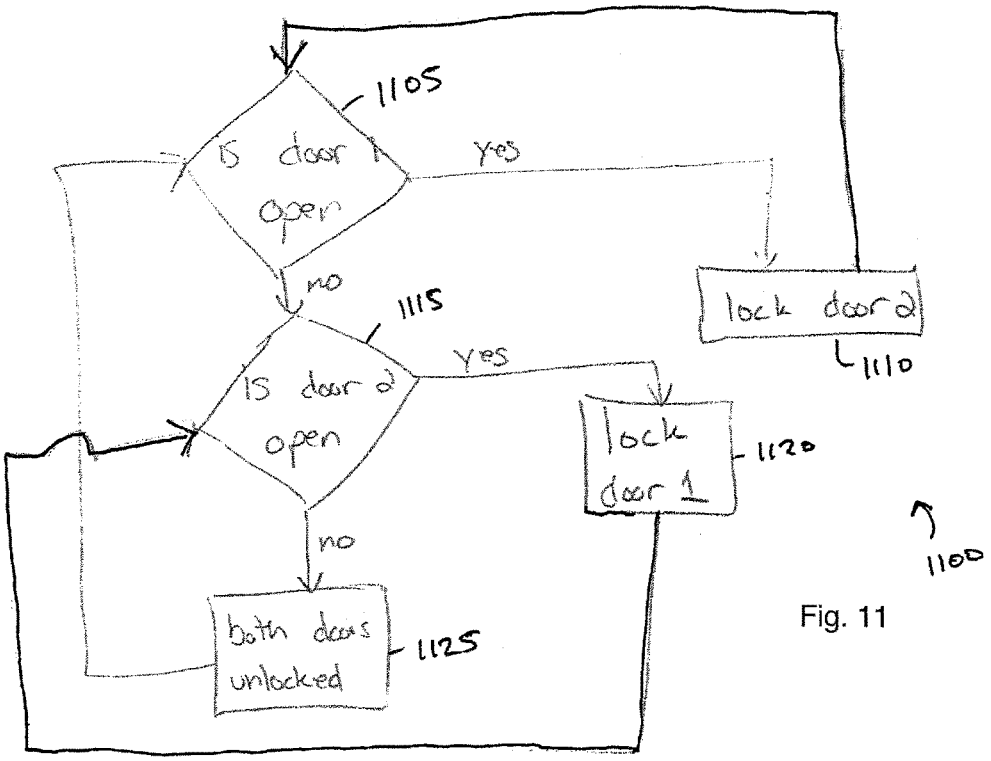
FIG. 11 is a process flow diagram illustrating a method of selectively controlling operation of dual doors of a microwave oven, in accordance with various embodiments.
Figure 12:
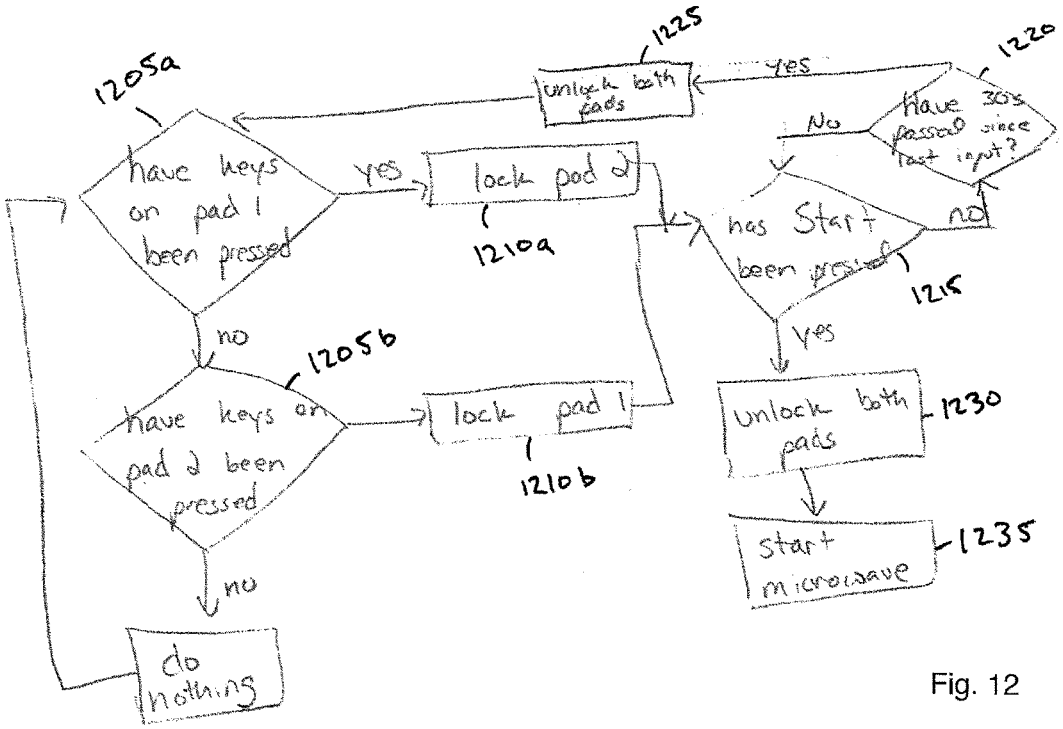
FIG. 12 is a process flow diagram illustrating a method of selectively controlling operation of dual keypads of a microwave oven, in accordance with various embodiments.

Turning to FIGS. 11 and 12, those drawings illustrate methods 1100 and 1200, respectively, that can be performed by a microcontroller of a microwave oven to provide operation when configured with multiple doors and/or multiple keypads, respectively.

The method 1100 of FIG. 11 comprises determining if a first door is open (block 1105). If so, the method 1100 includes locking the second door (block 1110) and returning to block 1105, in which case the second door will remain locked closed until the first door is closed. If the first door is not open, the method 1100 includes determining whether the second door is open (block 1115), in which case the first door is locked (block 1120) and the method returns to block 1115, indicating that the first door will remain locked closed until the second door is closed. If both doors are closed, both doors will are unlocked (block 1125) and either can be opened, and the method 1100 returns to block 1105.

The method 1200 of FIG. 12 comprises determining whether one or more keys on a first keypad have been pressed (block 1205*a*) and if not, whether one or more keys on a second keypad have been pressed (block 1205*b*). In either case, if one or more keys on one of the keypads have been pressed, the other keypad is locked and is inoperable (blocks 1210). At that point, the method 1200 determines whether a start key has been pressed on the operable keypad (block 1215). If not, the method 1200 waits for a timeout period (e.g., 30 seconds) while the inoperable keypad remains locked (block 1220) and then unlocks (and optionally resets) both keypads (block 1225), and the method 1200 returns to initial state. If the start button is pressed within the timeout period (block 1215), the method 1200 includes unlocking both keypads (block 1235) and starts operation of he microwave (block 1235).

While certain features and aspects have been described with respect to exemplary embodiments, one skilled in the art will recognize that numerous modifications are possible. For example, the methods and processes described herein may be implemented using hardware components, software components, and/or any combination thereof. Further, while various methods and processes described herein may be described with respect to particular structural and/or functional components for ease of description, methods provided by various embodiments are not limited to any particular structural and/or functional architecture but instead can be implemented on any suitable hardware, firmware and/or software configuration. Similarly, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A microwave oven, comprising:

an oven body;

a cooking chamber disposed inside the oven body;

a machine room disposed inside the oven body, the machine room, comprising:

a cooking device configured to introduce electromagnetic radiation in a microwave spectrum into the cooking chamber;

a first door, covering a first face of the cooking chamber, configured to provide access to the cooking chamber;

a second door, covering a second face of the cooking chamber, configured to provide access to the cooking chamber;

a locking mechanism configured to selectively lock the first and second doors in a closed position, the locking mechanism comprising a first switch configured to be in a first state when the first door is open, and a second state when the first door is closed;

a controller coupled to the locking mechanism, the controller configured to control the locking mechanism to prevent both doors from being in an open position simultaneously by preventing one of the first door or the second door of the microwave oven from opening, wherein the controller is configured to receive, via the first switch, a first signal indicative of whether the first switch is in the first state or the second state, wherein the controller is configured to cause the locking mechanism to lock the second door in response to a determination that the first switch is in the first state indicating that the first door is open, and wherein the controller is configured to cause the locking mechanism to unlock the second door in response to a determination that the first switch is in the second state indicating that the first door is closed;

a first keypad to operate the microwave oven; and a second keypad to operate the microwave oven.

2. The microwave oven of claim 1, wherein the cooking device is a magnetron.

3. The microwave oven of claim 1, further comprising a high voltage transformer to supply current to the cooking device.

4. The microwave oven of claim 1, further comprising a blower fan to remove excess heat and odor from the cooking chamber and machine room.

5. The microwave oven of claim 1, wherein the controller selectively disables the first and second keypads.

6. The microwave oven of claim 5, wherein the controller prevents both keypads from accepting input simultaneously while the microwave oven is not in operation.

7. The microwave oven of claim 1, wherein the first face of the cooking chamber and the second face of the cooking chamber are opposed.

8. The microwave oven of claim 1, wherein the first keypad is adjacent the first door, and wherein the second keypad is adjacent the second door.

9. The microwave oven of claim 1, wherein the first keypad is above the first door, and wherein the second keypad is above the second door.

10. The microwave oven of claim 1, wherein the first and second keypads comprise programmable buttons that change appearance based on the operability of each respective keypad.

11. The microwave oven of claim 1, wherein the first door and the second door are identical.

12. The microwave oven of claim 1, wherein the first keypad and the second keypad are identical.

13. A method of manufacturing the microwave oven of, comprising:

manufacturing a microwave oven comprising:

an oven body;

a cooking chamber disposed inside the oven body;

a machine room disposed inside the oven body, the machine room comprising a cooking device configured to introduce electromagnetic radiation in a microwave spectrum into the cooking chamber;

assembling a first door on the microwave oven;

assembling a second door on the microwave oven;

assembling a locking mechanism configured to selectively lock the first and second doors in a closed position, the locking mechanism further comprising a first switch configured to be in a first state when the first door is open, and a second state when the first door is closed;

assembling a controller, coupled to the locking mechanism, that controls the locking mechanisms to prevent both doors from being in an open position simultaneously by preventing one of the first door or the second door of the microwave oven from opening, wherein the controller is configured to receive, via the first switch, a first signal indicative of whether the first switch is in the first state or the second state, wherein the controller is configured to cause the locking mechanism to lock the second door based on a determination by the controller that the first switch is in the first state indicating that the first door is open, and wherein controller is configured to cause the locking mechanism to unlock the second door based on a determination by the controller that the first switch is in the second state indicating that the first door is closed;

assembling a first keypad on the microwave oven; and assembling a second keypad on the microwave oven.

14. A method comprising:

providing a microwave oven including a first door and a second door, a locking mechanism configured to selectively lock the first and second doors in a closed position, and a controller coupled to the locking mechanism;

causing, with the first door of the microwave oven, a first switch to be in a first state when the first door is open, and the first switch to be in a second state when the first door is closed;

generating, with the first switch, a first signal indicative of whether the first switch is in the first state or the second state;

receiving, with the controller of the microwave oven, the first signal;

determining, with the controller of the microwave oven, whether the first switch is in the first state or the second state based on the first signal;

causing, via the controller, the locking mechanism of the microwave oven to lock the second door of the microwave oven in response to a determination that the first switch is in the first state; and causing, via the controller, the locking mechanism of the microwave oven to unlock the second door of the microwave oven in response to a determination that the first switch is in the second state.

15. The method of claim 14, further comprising:

determining, with the controller of the microwave oven, that one of a first keypad or a second keypad of the microwave oven is in use; and selectively disabling, with the controller, the other of the first keypad or the second keypad of the microwave oven, based at least in part on a determination that the one of the first keypad or the second keypad is in use.

16. The method of claim 15, further comprising:

determining that a timeout period has elapsed since use of the one of the first keypad or the second keypad; and enabling the other of the first keypad or the second keypad based on a determination that the timeout period has elapsed.

17. The method of claim 16, wherein the timeout period is thirty seconds.

18. The method of claim 15, further comprising:

determining that a start button has been pressed on the one of the first keypad or the second keypad; and enabling the other of the first keypad or the second keypad based on a determination that a start button has been pressed on the first keypad.

19. The microwave oven of claim 1, wherein the locking mechanism comprises:

at least one first sensor that senses whether the first door is open or closed, the at least one first sensor being communicatively coupled to the controller;

at least one second sensor that senses whether the second door is open or closed, the at least one second sensor being communicatively coupled to the controller;

a first latch that engages with a corresponding latch on the first door in response to signals from the controller indicating to lock the first door; and a second latch that engages with a corresponding latch on the second door in response to signals from the controller indicating to lock the second door.

* * * * *